US005176096A

United States Patent [19]

Molnar et al.

[11] Patent Number: 5,176,096

[45] Date of Patent: Jan. 5, 1993

[54] ASSEMBLY FOR FASTENING A FIN TO A SAILBOARD

[75] Inventors: Ferenc Molnar, Micheldorf, Austria; Helmut Kirner, Wessling, Fed. Rep. of Germany

[73] Assignee: F2 International Ges.m.b.H., Kirchdorf/Krems, Austria

[21] Appl. No.: 695,502

[22] Filed: May 6, 1991

[30] Foreign Application Priority Data

May 18, 1990 [DE] Fed. Rep. of Germany ..... 9005686
Feb. 26, 1991 [DE] Fed. Rep. of Germany ..... 4105990

[51] Int. Cl.[5] ..... B63B 41/00
[52] U.S. Cl. ..... 114/127; 441/79
[58] Field of Search ..... 441/79; 114/127, 132, 114/140, 35.2

[56] References Cited

U.S. PATENT DOCUMENTS

| | | | |
|---|---|---|---|
| 3,516,099 | 6/1970 | Morey et al. | 441/79 |
| 3,516,100 | 6/1970 | Ellis | 441/79 |
| 3,579,681 | 5/1971 | Pope, III et al. | 441/79 |

FOREIGN PATENT DOCUMENTS

| | | | |
|---|---|---|---|
| 88430 | 9/1983 | European Pat. Off. | 441/79 |
| 3044714 | 6/1982 | Fed. Rep. of Germany | 441/79 |
| 2639897 | 6/1990 | France | 441/79 |

OTHER PUBLICATIONS

"Surf-Magazin", No. 4/90, pp. 55-58.

*Primary Examiner*—Sherman Basinger
*Attorney, Agent, or Firm*—Cushman, Darby & Cushman

[57] ABSTRACT

The assembly for fastening a fin to a sailboard comprises a fin receiving box secured in the sailboard and having an opening to receive a fin shaft. A conical or wedge seat is provided between the fin shaft and the opening in order to warrant a firm attachment of the fin.

45 Claims, 5 Drawing Sheets

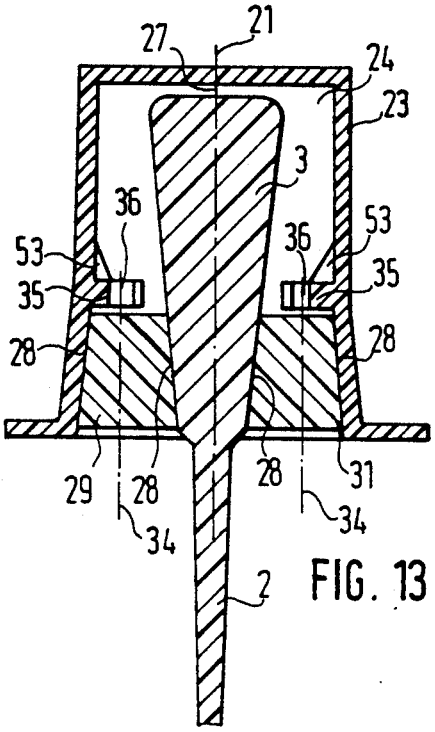
FIG. 13
FIG. 14
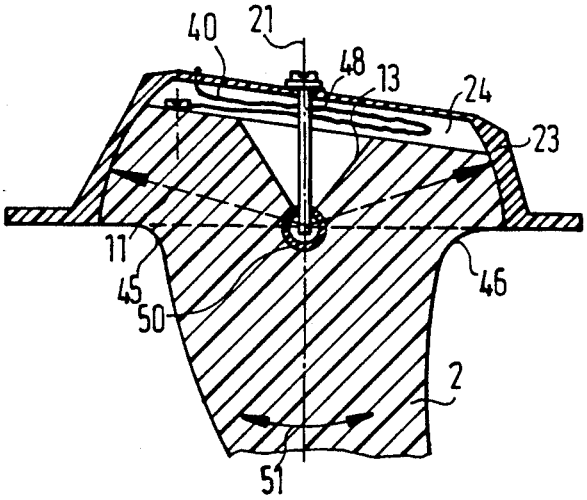
FIG. 15
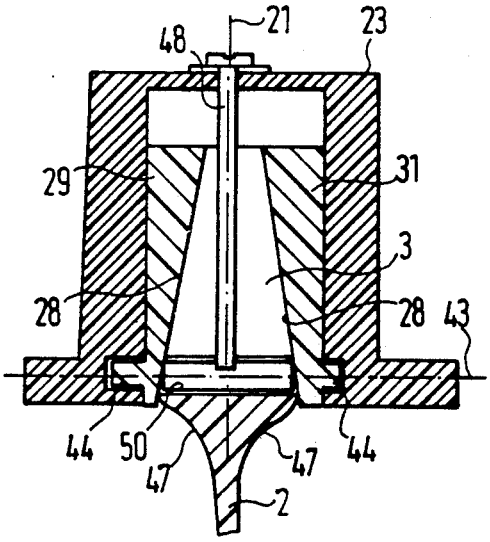

ASSEMBLY FOR FASTENING A FIN TO A SAILBOARD

FIELD OF THE INVENTION

The instant invention relates to a means for fastening a fin to a sailboard.

BACKGROUND OF THE INVENTION

Such fastening means have been known for a long time and were described for instance in the German journal "Surf-Magazin", no. 4/90, pages 55–58. Those known structures comprise a fin receiving or take-up box which is included in the laminate of the sailboard. The fin receiving box has an opening which faces the bottom side of the sailboard and in which a fin shaft is inserted and fixed by screws. With most of the known fastening means the opening is longer than the fin shaft so that adjustment is possible in the longitudinal direction. These designs often resulted in rupture of the fin at the fin shaft or, even more inconveniently, led to the fin box breaking out of the sailboard. Faulty material or defective design were made responsible for breakage of the first kind, the main cause being identified as sharp edges in the transitory area between the shaft and the fin (see the cited "Surf-Magazin").

With most designs, the ratio is very great between the length of the fin and the length of the shaft, being for example 9:1, and as a consequence the lever arm is unfavorable for fastening purposes. With the so-called Tuttle-Box (see the cited publication) this ratio was rendered more favorable by making the shaft longer. Thereby the fin receiving box becomes higher and extends substantially throughout the thickness of the sailboard. As viewed in a side elevation view the front and back of the fin shaft (with respect to the direction of movement) are oblique in order to permit the introduction of the shaft into the box housing it.

SUMMARY OF THE INVENTION

It is an object of the invention to improve a fastening means of the kind recited initially so that it will be even more stable.

The object is met, in accordance with the invention, in that at least one conical or wedge seat is provided for fastening of the fin shaft in the opening of the fin receiving box.

This conical fit provides a large-area contact zone between the side surfaces of the fin shaft and the associated surfaces of the opening in the fin receiving box. On the one hand, that means firm fitting without any clearance and, at the same time, reduced surface pressure of the mutually contacting parts, whereby the overall strength is increased. Moreover, the full surface area is carrying by virtue of the conical fit so that the full length of the fin shaft is available as lever arm.

So far that was not the case with the fin shafts having a rectangular cross section. There had to be a certain clearance if the fin shaft was to be inserted into the receiving box.

The principle of the cone angle seat can be varied in a great number of ways. The following basic principles are combined with each other:

(a) symmetrical or unsymmetrical cone, (b) conical seat between fin shaft and receiving box, (c) conical seat by one or two wedges which in turn may be symmetrical or unsymmetrical, (d) cone converging in a tip from transit area between fin blade and fin shaft toward free end of fin shaft or in opposite direction from free end of fin shaft in the direction of the transit area between the fin shaft and the fin blade, (e) fastening (screw thread connection) of the wedges or fin shaft from the deck of the sailboard or from the bottom thereof.

Further modifications of the invention suitable for combination with the above variants include possibilities of trimming by turning and/or translatory shifting of the fin with respect to the longitudinal axis of the sailboard.

The cone angle between a side surface and the principal axis preferably is 6°. If that is so, the fin still can be pulled out of the receiving box by hand, while the advantages of the conical fit are maintained.

In accordance with a further development of the invention the front (with respect to the direction of movement) of the fin shaft is curved like a segment of a circle. If the fin should run aground or on another obstacle, this will permit it to be turned out readily to the rear, based on the direction of movement. A radius of 120 mm was found to be especially advantageous for the curvature of the front edge.

The backside or rear edge of the fin shaft is inclined, preferably at an angle of inclination of 1°, to warrant perfect fixation of the fin also in longitudinal direction of the sailboard. Together with the curved front side this also provides a conical fit, with respect to the direction of movement.

According to a further development of the invention also the upper side or top edge of the shaft is designed to be sloping obliquely from front to rear (based on the direction of movement), preferably at an angle of inclination of 7.1°. In this manner the fin shaft is longer in the region of greater mechanical stress than in regions of lower loading, and as a result the forces are distributed most uniformly on the fin shaft with the smallest possible use of material. Preferably, the fin shaft is fixed to the fin receiving box by screws. The screw preferably is made of plastics and has an accurately defined rupture force. Upon contact with ground, the screw will break and the fin then can be removed without any further destruction.

Preferably a suitable, threaded insert for the screw is inserted in a depression in the upper side of the shaft.

Further advantageous modifications and developments of the invention may be gathered from the subclaims.

BRIEF DESCRIPTION OF THE DRAWING

The invention will be described further, by way of example, with reference to the accompanying drawings, in which:

FIGS. 5 to 13 are cross sections of the fin shaft installed in the fin receiving box in accordance with different embodiments of the invention;

FIG. 14 is a side elevation of the fastening means with trimming facility by pivoting;

FIG. 15 is a cross section of the fastening means shown in FIG. 14;

DESCRIPTION OF THE PREFERRED EMBODIMENTS

Figure 4:
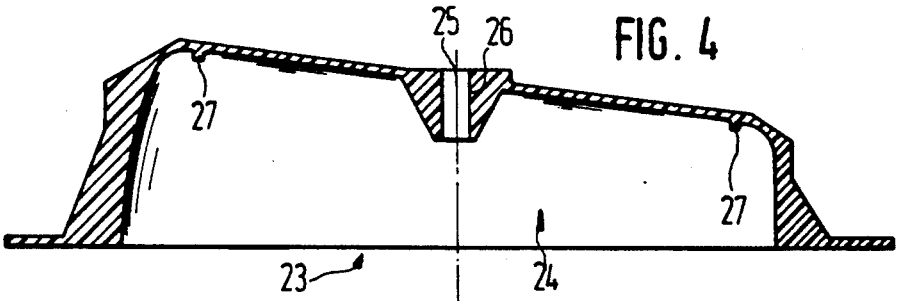
FIG. 4 is a longitudinal sectional view of the fin receiving box according to a first embodiment of the invention.

To begin with, the first embodiment will be described with reference to FIGS. 1 to 4.

The fin 1 comprises a fin blade 2 and a fin shaft 3 formed integrally with the blade. In the side elevational view of FIG. 1 the front edge 4 of shaft 3 oriented in the direction of movement has a segmental curvature, having a radius 11 which, in this case, is 120 mm. The top edge 5 is downwardly inclined from the front edge 4 toward the backside or rear edge 6. The bottom edge 7 of the shaft with which the fin blade 2 is formed in one piece takes a rectilinear course, extending approximately vertically with respect to a central or main axis 21.

Figure 2:
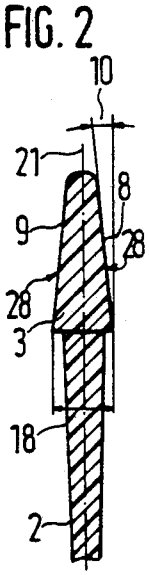
FIG. 2 is a cross section of the fin shaft along line A-B in FIG. 1 according to a first embodiment of the invention.
Figure 1:
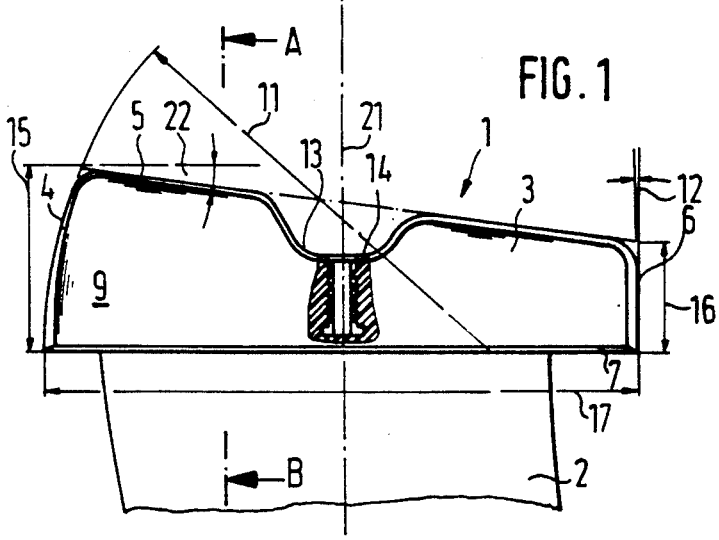
FIG. 1 is a side elevational view of the fin shaft according to a first embodiment of the invention.

As may be seen in the cross section of FIG. 2, the two side surfaces 8 and 9 of the shaft extend in mirror symmetry with respect to the main axis 21 and taper conically toward the free end of the shaft at a cone angle 10 which preferably is 6° at each of the side surfaces.

The rear edge 6 of the fin shaft 3 is designed to converge toward the free end of the shaft at an angle of inclination 12 of 1°.

Approximately in the middle of the top edge 5 of the fin shaft 3 there is a depression 13 in which a threaded insert 14 is received.

Figure 3:
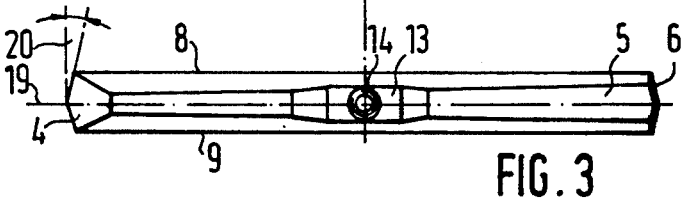
FIG. 3 is a top plan view on the upper side of the fin shaft according to a first embodiment of the invention.

As best shown in the top plan view of FIG. 3, the front edge 4, the top edge 5, and the rear edge 6 are inclined in mirror symmetry with respect to a central plane 19, the angle of inclination 20 between a perpendicular to the central plane 19 and the corresponding surface being 14°.

The angle of inclination 22 of the top edge 5 with respect to the bottom edge 7 is 7.1°.

The height 15 of the front edge 4 measured vertically from the bottom edge 7 preferably is 49.5 mm. The height 16 of the rear edge 6 is 29.5 mm. The length of the bottom edge 7 is 160.2 mm. The thickness 18 of the shaft measured at the bottom edge 7 is 16.1 mm. These dimensions were found to be particularly advantageous as they provide optimum strength with the smallest possible use of material when applied in combination with the plastics material selected and the limiting conditions given by the thickness of the usual sailboards.

FIG. 4 shows the fin receiving box 23 formed with an opening 24 for introduction of the fin shaft. The screw already mentioned is threaded through an upper hole 25 and a sleeve 26 following it. Two lugs 27 are provided on the bottom of the opening 24 to serve as stops for the top edge 5 of the fin shaft 3 so as to prevent it from becoming keyed too firmly. As the sleeve 26 projects into the interior of the opening 24, the fin shaft is formed with the depression 13. The sleeve functions as a stiffenings means of the fin receiving box. A plurality of projecting webs (not shown) are formed on the outside of the fin receiving box to warrant anchoring in form lock of the fin box in the sailboard.

The embodiments shown in FIGS. 5 to 13 essentially illustrate different forms of the conical or wedge seat or fit. While the embodiment according to FIGS. 1 to 4 comprises a fin shaft 3 which converges symmetrically in a tip, in mirror symmetry, as seen in cross section (FIG. 2), other variants are combined in FIGS. 5 to 13. More specifically, these are:

(a) unsymmetrical cone, i.e. only one side surface of the fin shaft defines the conical seat,
(b) conical seat defined by one or two symmetrical or unsymmetrical wedges,
(c) conical fin shaft tapering from the free end toward the fin blade,
(d) fastening (screw threading) of the wedges or fin shaft from the deck of the sailboard or from the bottom thereof.

All of these basic principles are suitable for a wide range of combinations not all of which are illustrated in FIGS. 5 to 13.

Figure 5:
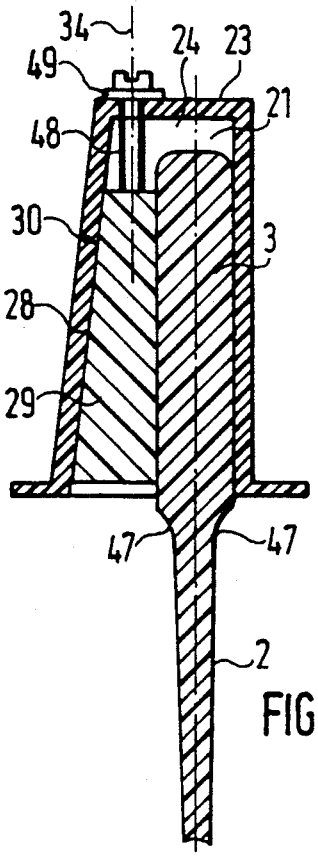

In the case of the embodiment according to FIG. 5 the fin shaft 3 is of square cross section The conical seat 28 is obtained by a wedge 29 which is oblique at one side and has this oblique side 30 abut against an inner wall of the fin receiving box 23. The fin blade 2 is pulled in toward the deck of the sailboard or into the opening 24 by a screw 48 so as to secure the fin shaft 3 by clamping it against the opposite side wall of the fin receiving box. With this variant embodiment the fin is retained exclusively by friction, and these frictional forces are adjustable by the tightening of the screw 48. Moreover, the position of the fin is adjustable with respect to the longitudinal axis, and that presents an opportunity for some trimming.

Figure 6:
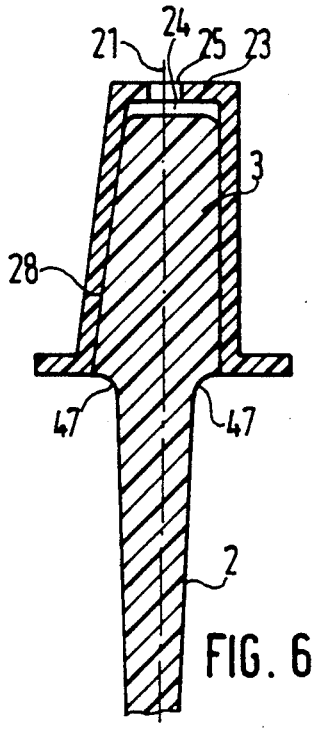

FIG. 6 shows a variant embodiment similar to the one illustrated in FIGS. 1 to 4, yet with an unsymmetrical cross section of the fin shaft 3 and a one-sided conical fit, while the opposite side is straight. ----.

It should be noted with reference to FIGS. 5 and 6 that the transitional zone between the fin shaft 3 and the fin blade 2 is rounded by a radius 47 which affords great improvement of the stability. In this manner notches in this area are avoided which would be prone to rupture.

Figure 8:
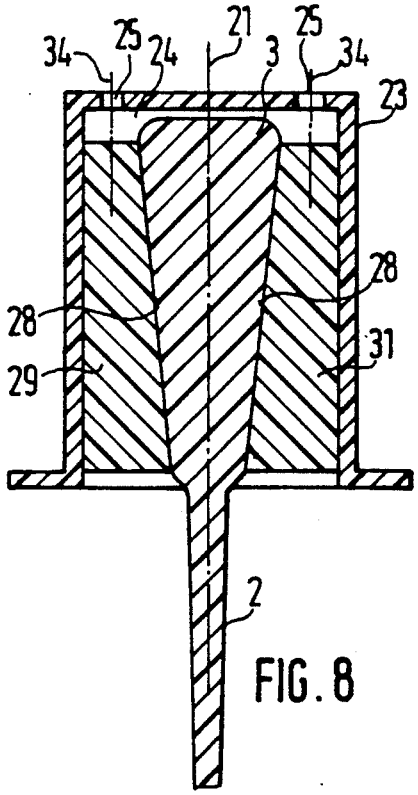
Figure 9:
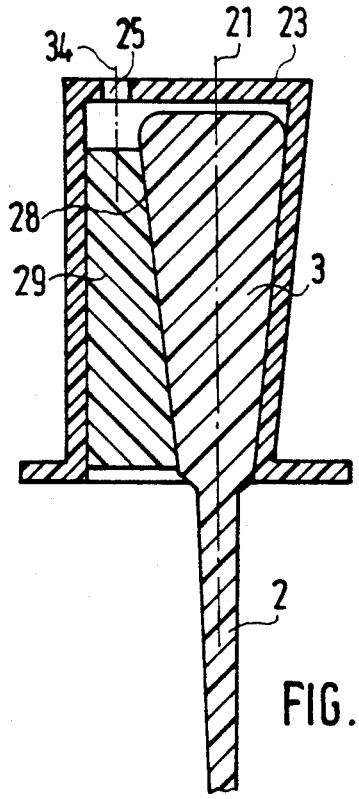
Figure 10:
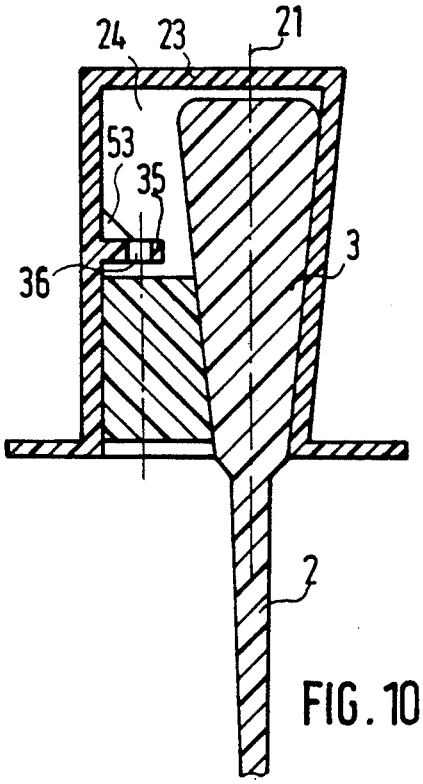

In the case of FIGS. 7 to 13, the cone of the conical seat extends in the opposite direction, in other words the fin shaft 3 converges in a tip from its free end toward the fin blade 2. With these variant embodiments, one or two corresponding wedges 29 or 29 and 31 always are used, and they are screwed in from the deck (FIGS. 7, 8, 9, 11, and 12) or from the bottom of the sailboard (FIGS. 10 and 13).

Figure 7:
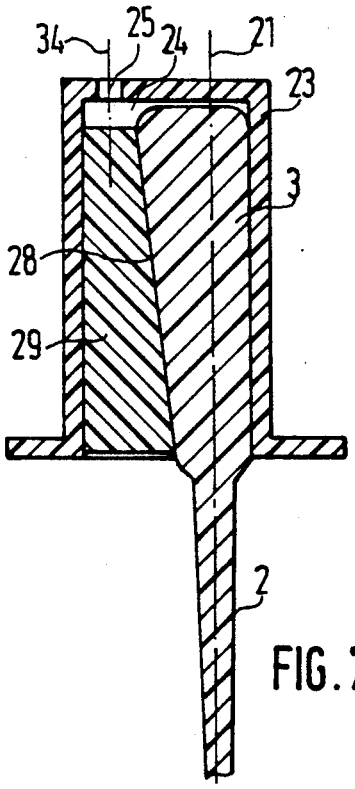

In analogy with the embodiment of FIG. 6, the embodiment according to FIG. 7 comprises an unsymmetrically conical fin shaft which is secured by wedge 29. The fin shaft is pulled into the opening 24 until it abuts against the top. If desired, such abutment may be defined additionally by lugs 27 serving as stops (see FIG. 13). The screw is introduced from the deck through the hole 25. The wedge 29 includes a corresponding threaded sleeve (not shown). The opening 24 is square in cross section.

FIG. 8 illustrates a similar embodiment which, however, is made entirely in mirror symmetry, including two wedges 29 and 31. The wedges are unsymmetrical and the opening 24 is square.

FIG. 9 illustrates an embodiment with a symmetrical cone cross section of the fin shaft 3, an unsymmetrical wedge 29, and an unsymmetrical opening 24. A sidewall of the fin receiving box 23 is oblique to match the inclination of the cone. Yet the opposite sidewall lies in parallel with the central axis, corresponding to the side of the wedge 29 facing it. Again the screw thread connection is made from the deck.

FIG. 10 shows a variant similar to FIG. 9 but differs from it in that the screw thread connection is made from the opening end of the fin receiving box. To this end, a web 35 formed with a threaded sleeve 36 projects into the interior of the opening 24, at right angles to the central axis 21, in order to take up the fastening screw. The web 35 may be reinforced by a stiffening fin 53. The screw is passed through a through bore provided in the wedge 29 and then threaded into the threaded sleeve 36.

Figure 11:
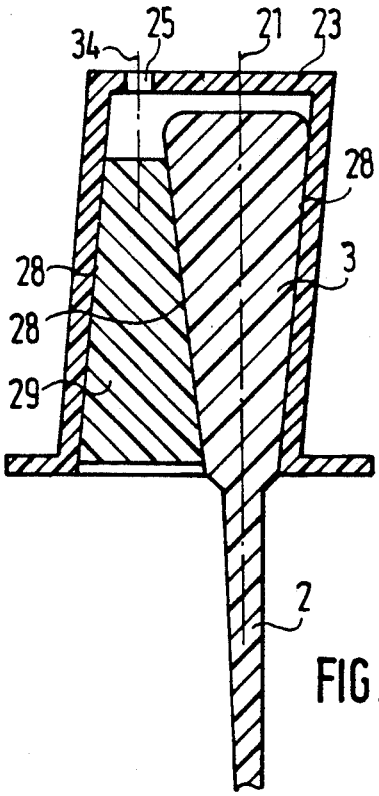

FIG. 11 shows an embodiment in which the fin shaft 3 has a cone cross section in mirror symmetry, the wedge 29 has a cross section in mirror symmetry, two conical seats 28 are provided, and the sidewalls of the fin receiving box are inclined with respect to the central axis 21. The screw threading to fix the wedge is effected from the deck end.

Figure 12:
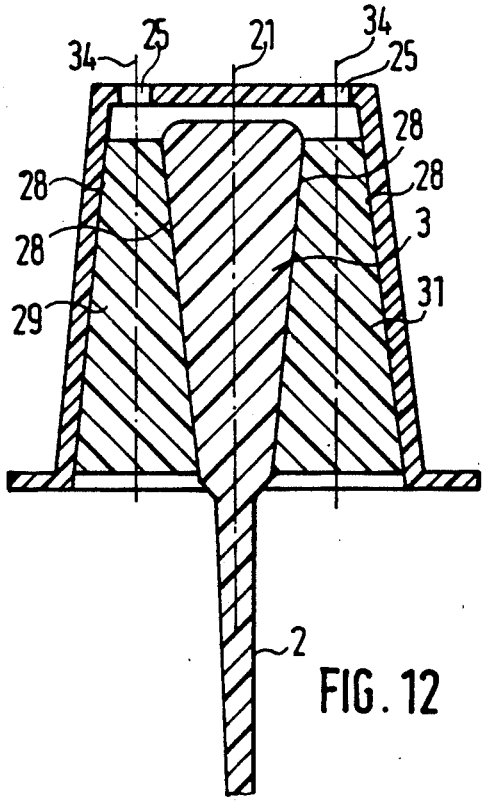

FIG. 12 shows an embodiment in which the fin shaft 3 has a cone cross section in mirror symmetry, two wedges 29 and 31 of mirror symmetrical configuration are provided, and the sidewalls of the fin receiving box are inclined toward each other. Again the screw threading is accomplished from the deck end.

FIG. 13 shows a variant which is analogous to FIG. 12, yet has the screw threading done from the bottom side, as is the case with the embodiment shown in FIG. 10.

According to another modification, not illustrated here, the fin is introduced into the fin receiving box from the deck of the sailboard and the opening in this instance tapers conically from the deck side toward the water side. The fin shaft is pressed into the opening by means of a cover plate which is attached by means of a screw thread.

Figure 16:
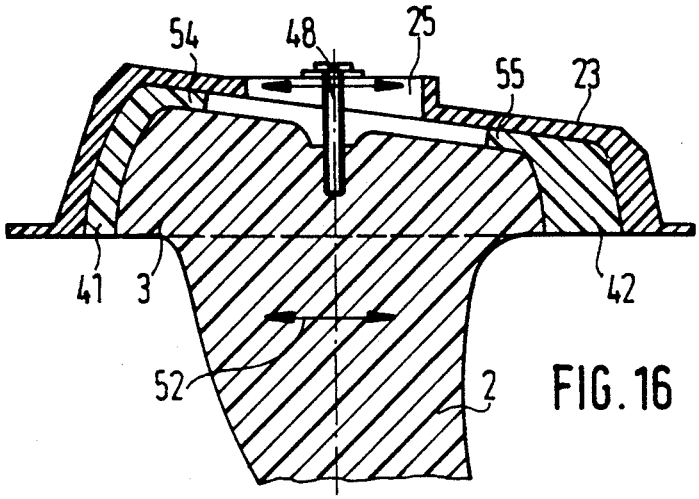
FIG. 16 is a longitudinal section of the fastening means with trimming facility by longitudinal displacement of the fin shaft.

The embodiments illustrated in FIGS. 14 to 16 offer various possibilities of trimming to adjust the relative positions of fin and fin receiving box. In the case of FIGS. 14 and 15 the fin can be turned around a pivot axis 43. In the case of FIG. 16 the fin can be displaced by translatory motion in the longitudinal direction of the sailboard (see arrow 52). Furthermore, these two variations can be combined so that the fin will be pivotable as well as displaceable longitudinally.

FIGS. 14 and 15 show the fin and the fin receiving box in the longitudinal and transverse sections, respectively. A pivot bearing 50 embodied by a sleeve or bolt inserted in a bore transversely of the central axis 21 is provided in the area of transit from the fin shaft 3 to the fin blade 2. This sleeve is formed with a threaded bore adapted to receive the screw 48. As the threaded bore extends parallel to the central axis 21, it is located at right angles to the pivot axis 43. The depression 13 formed in the fin shaft extends up to the sleeve 50, and the angle of opening of the depression defines the limits of the pivoting movement which the fin is permitted to make. The front edge and the rear edge (as seen in side elevation) are given a circular curvature in order to warrant good fitting of the fin shaft in the fin receiving box in spite of the pivoting movement permitted. Both circular segments are part of a common circle whose center lies on the pivot axis 43. Therefore, both radii 11 are the same.

In order for the lateral conical seat 28 (FIG. 15) to permit pivoting of the fin, the wedges 29 and 31 must be movable with this embodiment. The easiest way to achieve that is to make also the opposed wedges 29 and 31 pivotable about the pivot axis 43. To that end, both wedges may be supported by pins 44 in pivot bearings of the fin receiving box 23.

It would be obvious to a person skilled in the art based on the above disclosure that the pivoting may also be provided similarly in the case of the embodiments shown in FIGS. 5 and 7 to 13. In the case of FIG. 5 that can be achieved without any additional measures. With the other variant embodiments care must be taken that the wedges are pivoted in unison with the pivoting of the fin. Conveniently, the wedges are provided with a pivot bearing similar to the sleeve 50 and with a depression in analogy to the depression 13.

FIG. 16 presents a variant embodiment with which the fin can be moved in a translatory sense parallel to the longitudinal direction of the sailboard (see arrow 52). The through hole 25 at the upper side of the fin receiving box in this case is an oblong hole. The opening 24 of the fin receiving box 23 is longer than the fin shaft.

Insert pieces 41 and 42 of different thickness are provided for additional fixing of the fin, whereby the position of the fin with respect to the fin receiving box can be determined precisely. A set of insert pieces of different thicknesses permits the position to be varied. Assembly is facilitated by the fact that the insert pieces 41 and 42 are formed with legs 54 and 55, respectively, which project above the upper side of the fin shaft and, at the same time, serve as stops.

This modification is suitable for combination with the modification shown in FIGS. 14 and 15, thus permitting a wide range of adjustability of the fin.

Figure 17:
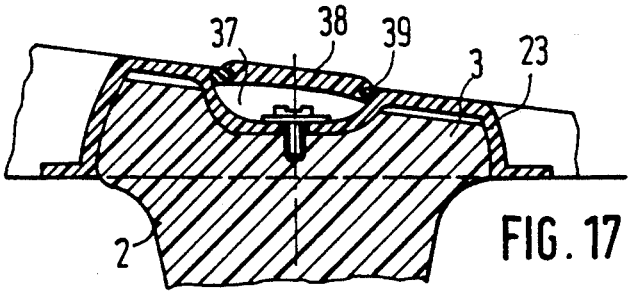
FIG. 17 is a longitudinal section of a modification of the invention, including a water-tight depression for storing articles.

FIG. 17 illustrates another modification which is applicable with all the variant embodiments presented. Here the top of the fin receiving box is arranged to be depressed, like the depression 13 (FIG. 1), thereby presenting a depression 37 at the outside of the fin receiving box. This depression can be closed by a cover 38 which is sealed by a continuous seal 39 around it. In this manner a hermetically sealed cavity is formed which may serve as a receptacle for tools, spare parts, etc.

In accordance with another modification of the invention, presented in FIG. 14, the fin is securely held by a drag line 40 attached to the fin shaft, on the one hand, and to the fin receiving box, on the other hand. When the screw 48 breaks at its intended point of rupture if an underwater obstacle should be hit, the fin will not be lost thanks to this drag line. The screw is preferably made of plastics and has an accurately defined rupture force. Upon contact with the ground, the screw will break and the fin shaft can then be removed without any destruction of either the fin receiving box or the fin shaft. The screw is formed with a notch 65 (as shown in FIG. 14) transversely of its longitudinal axis to serve as the desired rupture location. Similar safety measures may be applied to the wedges in the various embodiments.

What is claimed is:

1. An assembly for fastening a fin to a sailboard comprising:

a fin shaft, the fin shaft having a top edge, a front edge, a bottom edge and a rear edge, the front edge extending from the top edge to the bottom edge; and a fin receiving box secured in the sailboard and having an opening to receive the fin shaft, the opening of the receiving box having at least one side facing one side of the fin shaft, said both sides being inclined at an acute angle with respect to a central axis of the fin shaft to form a wedge seat between he fin shaft and the fin receiving box, the fin shaft being tapering in the direction toward a free end of the fin shaft, the opening of the fin receiving box mates with the fin shaft, wherein substantially the entire front edge of the fin shaft is of curved shape, said curved shape of said front edge being a segment of a circle, and wherein the fin shaft rear edge is inclined obliquely with respect to the central axis of the fin shaft.

2. The fastening assembly as claimed in claim 1, wherein the vertical cross section of the fin shaft is symmetrical.

3. The fastening assembly as claimed in claim 1, wherein the vertical cross section of the fin shaft is unsymmetrical.

4. The fastening assembly as claimed in claim 1, wherein the wedge seat is provided with reference to the longitudinal section of the fin shaft.

5. The fastening assembly as claimed in claim 1, wherein the fin shaft is tapered from its free end toward a fin blade.

6. The fastening assembly as claimed in claim 1, wherein at least one wedge is inserted in the opening of the receiving box, said at least one wedge has at least one surface that is inclined with respect to the central axis and defines the wedge seat together with at least one correspondingly inclined surface of the fin blade.

7. The fastening assembly as claimed in claim 6, wherein two wedges are provided, the fin shaft is arranged between the two wedges.

8. The fastening assembly as claimed in claim 6 wherein the wedge is of mirror symmetrical configuration such that its two wedge surfaces extend at the same acute angle with respect to a central axis.

9. The fastening assembly as claimed in claim 6 wherein the wedge is unsymmetrical such that its one wedge surface extends parallel to the central axis, while its other wedge surface extends at an acute angle with respect to the central axis.

10. The fastening assembly as claimed in claim 9, wherein the fin shaft is connected to the fin receiving box from the top of the sailboard by a threaded connection.

11. The fastening assembly as claimed in claim 9, wherein the wedge is connected to the fin receiving box from the bottom of the sailboard by a threaded connection.

12. The fastening assembly as claimed in claim 11, wherein the fin receiving box comprises at least one web projecting into the interior of the receiving opening transversely of the central axis, and said at least one web has a threaded bore to receive a screw.

13. The fastening assembly as claimed in claim 12, wherein a wedge angle of the wedge seat is approximately 6°.

14. The fastening assembly as claimed in claim 9, wherein the wedge is connected to the fin receiving box from the top of the sailboard by a threaded connection.

15. The fastening assembly as claimed in claim 1, wherein the fin shaft has a rear edge of curved shape, said curved shape of said rear edge being a segment of a circle.

16. The fastening assembly as claimed in claim 15, wherein a radius of the circle of the front edge and the rear edge is approximately 120 mm.

17. The fastening assembly as claimed in claim 16, wherein the center of the circle for the circle radius of the front edge and that of the rear edge is a common point.

18. The fastening assembly as claimed in claim 17, wherein the common circle center lies in a plane of a bottom edge of the fin shaft.

19. The fastening assembly as claimed in claim 18, wherein the angle of inclination between a main axis and the rear edge of the fin shaft is approximately 1°.

20. The fastening assembly as claimed in claim 19, wherein the height of the fin shaft is greater at the front edge than at the rear edge.

21. The fastening assembly as claimed in claim 20, wherein the height of the fin shaft at the front edge is approximately 49.5 mm and the height of the fin shaft at the rear edge is approximately 29.5 mm.

22. The fastening assembly as claimed in claim 21, wherein the top edge of the fin shaft has an angle of approximately 7° with a perpendicular to a main axis of said fin shaft.

23. The fastening assembly as claimed in claim 22, wherein a depression is formed in the top edge of the fin shaft.

24. The fastening assembly as claimed in claim 23, wherein a threaded insert is located in the bottom of the depression.

25. The fastening assembly as claimed in claim 23 or 24, wherein a depression is formed in the upper said of the fin receiving box, the depression in the fin receiving box is accessible from the top of the sailboard and includes means for closing the depression by a cover.

26. The fastening assembly as claimed in claim 25, wherein a seal is disposed between the cover and the depression.

27. The fastening assembly as claimed in claim 26, wherein the front edge, the top edge, and the rear edge of the fin shaft are symmetrical with respect to the central plane and include an angle of approximately 14° with a perpendicular to this central plane.

28. The fastening assembly as claimed in claim 27, wherein the fin receiving box has a through bore opposite the threaded insert, made of plastics is threaded into the through bore, the screw has a predetermined resistance to fracture.

29. The fastening assembly as claimed in claim 28, wherein the screw is formed with a notch transversely of its longitudinal axis to serve as the desired rupture location.

30. The fastening assembly as claimed in claim 29, wherein the fin shaft is connected to the fin receiving box by a drag line.

31. The fastening assembly as claimed in claim 30, wherein the length of the opening of the fin receiving box, in the longitudinal direction of the sailboard, is greater than the length of the fin shaft.

32. The fastening assembly as claimed in claim 31, wherein the through bore at the top of the fin receiving box is an oblong hole.

33. The fastening assembly as claimed in claim 32, wherein exchangeable insert pieces are provided at the front edge and rear edge of the fin shaft.

34. The fastening assembly as claimed in claim 33, wherein the insert pieces have different dimensions, as measured in the longitudinal direction of the sailboard.

35. The fastening assembly as claimed in claim 34, wherein the fin shaft is supported for pivoting movement about an axis extending transversely of the longitudinal axis of the sailboard.

36. The fastening assembly as claimed in claim 35, wherein the pivot support comprises a threaded bore which extends transversely of the pivot axis, the depression extends up to the threaded bore of the pivot support.

37. The fastening assembly as claimed in claim 36, wherein the wedge seat is defined by two opposed wedges which are pivotable about the pivot axis.

38. The fastening assembly as claimed in claim 37, wherein the opposed wedges are supported by pins for pivoting movement with respect to the fin receiving box.

39. The fastening assembly as claimed in claim 38, wherein a radius is provided in the transitional zone between the fin shaft and the fin blade.

40. The fastening assembly as claimed in claim 39, wherein the radius at the leading edge of the fin blade is smaller than the radius at the trailing edge.

41. The fastening assembly as claimed in claim 40, wherein the transitional zone between the fin blade and the fin shaft is formed with a radius.

42. The fastening assembly as claimed in claim 41, wherein the radius in the transitional zone of the cross section approximately equals the radius of the leading edge in side elevation.

43. The fastening assembly as claimed in claim 42, wherein the screw is disposed approximately in the middle between the front edge and the rear edge of the fin shaft.

44. The fastening assembly as claimed in claim 43, wherein the fin receiving box is hermetically sealed with respect to the sailboard deck.

45. The fastening assembly as claimed in claim 1, wherein at least one wedge is inserted in the opening of the receiving box, said at least one wedge has at least one surface that is inclined with respect the central axis and defines the wedge seat together with at least one correspondingly inclined surface of the opening.

* * * * *